United States Patent [19]

Scott

[11] Patent Number: 4,672,719

[45] Date of Patent: Jun. 16, 1987

[54] UPHOLSTERY BUTTON

[75] Inventor: Gregory C. Scott, Auckland, New Zealand

[73] Assignee: Development Finance Corporation of New Zealand, Auckland, New Zealand

[21] Appl. No.: 841,665

[22] Filed: Mar. 19, 1986

Related U.S. Application Data

[63] Continuation-in-part of Ser. No. 596,302, Apr. 3, 1984, abandoned.

[30] Foreign Application Priority Data

Apr. 14, 1983 [NZ] New Zealand ..... 203886

[51] Int. Cl.[4] ..... A44B 1/12

[52] U.S. Cl. ..... 24/113 R; 24/113 MP; 24/92

[58] Field of Search ..... 24/113 R, 113 MP, 90 C, 24/92, 453, 90 A, 101 R

[56] References Cited

U.S. PATENT DOCUMENTS

| | | | |
|---|---|---|---|
| 1,446,801 | 2/1923 | Kuckelsberg et al. | 24/113 R |
| 2,246,316 | 6/1941 | Oharek et al. | 24/113 R |
| 2,717,434 | 9/1955 | Duell | 24/113 R |
| 2,799,908 | 7/1957 | Morin | 24/113 R |
| 3,087,215 | 4/1963 | Tworek et al. | 24/113 R |
| 3,242,544 | 3/1966 | Dritz | 24/113 R |
| 3,425,101 | 2/1969 | Reynolds | 24/113 R |
| 3,771,199 | 11/1973 | Eldringhoff | 24/92 |
| 3,934,314 | 1/1976 | Whysall | 24/113 R |
| 4,198,733 | 4/1980 | Ferguson et al. | 24/92 |
| 4,283,815 | 8/1981 | Henshaw | 24/90 C |

FOREIGN PATENT DOCUMENTS

| | | | |
|---|---|---|---|
| 221014 | 10/1956 | Australia . | |
| 805193 | 5/1951 | Fed. Rep. of Germany | 24/113 R |
| 177925 | 4/1922 | United Kingdom | 24/92 |

*Primary Examiner*—Victor N. Sakran
*Attorney, Agent, or Firm*—Young & Thompson

[57] ABSTRACT

A plastics button assembly comprises an outer body component, an inner body component trapped substantially non-retrievably within a recess in the rear of the outer body component, and a cloth cover substantially covering the front of said outer body component, the edges of which are trapped securely between the engaging surfaces of said outer and inner body components. A shank extends from within the recess of the outer component and the inner component is engaged about and supported by the shank. The inner component is a specially shaped annular plastic washer having a flat inner face and a contoured outer face. An annulus of reduced thickness extends about a central aperture, and this annulus is surrounded by an annulus of maximum thickness which tapers towards the periphery of the washer. This allows the plastics button to be assembled in a conventional two piece die set as used for metal shell buttons.

9 Claims, 7 Drawing Figures

UPHOLSTERY BUTTON

This application is a continuation-in-part of application Ser. No. 596,302, filed Apr. 3, 1984, and now abandoned.

BACKGROUND OF THE INVENTION

This invention relates to improvements in buttons and, more particularly, to improvements in covered buttons.

In the past, when covered buttons have been produced it has been usual to provide the base for the covered buttons in a combination of sheet metal and metal wire. The sheet metal portions are arranged as a pair of interengaging cups, these being an outer cup which forms the outer part of the button about which the cover material is drawn, and an inner cup which faces towards the concave inside face of the outer cup and pushes the edge portions of the cover material wrapped about the outer periphery of the outer cup between them. The assembly is then swaged or compressed to clamp the material about the outer component. A securing means for the button is provided by engaging a wire loop in apertures in the inner cup. In some arrangements, the inner piece is formed of a plastics material, still with a metal cap crimped over it. The shank is attached to the inner piece, usually being integral with it.

Serious difficulties have been encountered in providing buttons in such a manner in that it is, of course, necessary to have machinery and equipment to swage the assembled cups with the material in place. Where a large variety of sizes and thicknesses of material are needed it is necessary to have apparatus to suit the variety of sizes. Provision of this equipment can in certain instances be expensive, inefficient and/or inconvenient.

There is a further problem with buttons so formed that, unless the swaging is done with skill, the resultant button may be less than adequately assembled and may tend to fall apart in use.

Attempts have been made to provide covered buttons in alternative constructions, utilizing a differing means of securement for the inner component to hold the material in place. Hitherto, buttons have been produced wherein an integral shank extends outwardly from the rear surface of the outer cup with which an apertured rear component is engaged, to bind the material about the outer face of the outer component and around its rear edges to form the covered button. However, these buttons have generally been unacceptable owing to their being too deep.

Further problems have been encountered owing to rusting, discolouration or oxidization of steel, stainless steel or aluminium parts of buttons. This causes discolouration of adjacent fabrics and fixing threads for the button. Eventually, the rusting, discolouration or oxidation causes the fastening thread or the squab or cushion material to rot and the button then falls away from its fastening point.

PRIOR ART

Examples of metal buttons are disclosed in:

| | | |
|---|---|---|
| GB | 177,925 | Rendel |
| US | 2,799,908 | Morin |
| US | 1,446,801 | Kuekelsberg et al |

-continued

| | | |
|---|---|---|
| US | 3,500,506 | Mitchell |
| US | 3,242,544 | Dritz |

Many attempts have been made to provide plastics buttons but these have not been successful. They cannot be used with assembly dies used for the metal shell buttons which despite their disadvantages continue to dominate the market for covered buttons.

Examples of plastics buttons are disclosed in:

| | | |
|---|---|---|
| AU | 221014 | Raposi |
| US | 2,246,316 | Oharek et al |
| US | 2,602,975 | Wolfe |
| US | 3,087,215 | Tworek et al |
| US | 3,648,331 | Kruger |
| US | 3,771,199 | Eldringhoff |
| US | 3,934,314 | Whysall |
| US | 4,169,302 | Ferguson |
| US | 4,283,815 | Henshaw |
| US | 4,387,488 | Kanzaka. |

It is an object of the present invention to come some way in overcoming the abovementioned problem or at least to provide the public with a useful choice in providing an improved plastics button. Other objects of this invention will become apparent from the following description.

SUMMARY OF THE INVENTION

In a first aspect, the present invention broadly consists in a button assembly including an outer body component, a shank extending from a mid-portion of said outer body component, and an inner body component adapted to be substantially non-releasably snap-fitted into said outer body component; wherein the inner body component comprises an annular washer having a peripheral rim, a substantially flat inner face which in use faces towards the recess of the outer body component, and a contoured outer face, an aperture through said washer, an annulus of reduced thickness about said aperture terminating in a region of maximum thickness which tapers towards the peripheral rim of the washer to define the contoured outer face.

The shape of this inner body component allows it to flex when pushed over the shank by a button die set.

In a second aspect, the present invention broadly consists in a kitset for a button assembly including an outer body component forming at least part of the button periphery, a shank arranged to extend rearwardly of said outer body component and through an aperture provided in a separate inner body component, a recess provided in a rear face of said outer body component within which a periphery of said inner body component can engage substantially non-releasably and locate a covring engaged about at least a part of the outer body component and extending between the periphery of said inner body component and adjacent portions of said recess; wherein the inner body component comprises an annular washer having a peripheral rim, a substantially flat inner face which in use faces towards the recess of the outer body component, and a contoured outer face, an aperture through said washer, an annulus of reduced thickness about said aperture terminating in a region of maximum thickness which tapers towards the peripheral rim of the washer to define the contoured outer face.

In a third aspect, the present invention broadly consists in a button comprising an outer body component, an inner body component trapped substantially non-retrievably within a recess in the rear of the outer body component about a shank extending from within the recess, and a cloth cover substantially covering the front of said outer body component, the edges of which are trapped securely between the engaging surfaces of said outer and inner body components; wherein the inner body component comprises an annular washer having a peripheral rim, a substantially flat inner face which in use faces towards the recess of the outer body component, and a contoured outer face, an aperture through said washer, an annulus of reduced thickness about said aperture terminating in a region of maximum thickness which tapers towards the peripheral rim of the washer to define the contoured outer face.

DESCRIPTION OF THE PREFERRED EMBODIMENT

Figure 1:
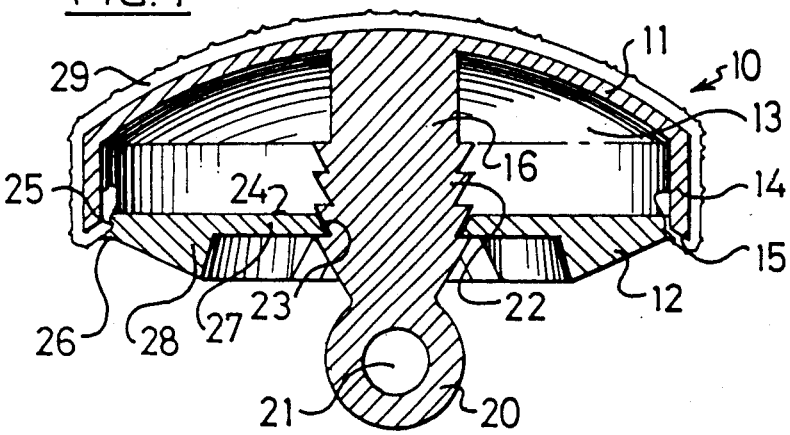
FIG. 1 is a cross-sectional view of a button formed in accordance with the present invention.

Referring to FIG. 1 of the drawings, the button 10 is formed of an outer body component 11 and an inner body component 12. The button 10 is formed in a mouldable, or settable material, such as a thermoplastics resin, for example. However, the button can, alternatively, be formed in other plastics materials.

The ouer body component 11 is generally outwardly convex, and inwardly recessed to provide a recess 13 on a rear face of it.

Preferably, the outer face of the component 11 is of a shape which is substantially the ultimately required shape of the assembled button. Peripheral portions 14 of the outer body component 11 may be provided, extending rearwardly of the body component 11 and defining the overall depth of the recess 13 behind the outer body component 11. Preferably, an inwardly tapered face 15 is provided about the edge of the outer body component periphery 14 to provide a "lead in" for an inner body component 12 when it is engaged within the recess 13.

A shank 16 extends outwardly from the centre of the recess 13. An end portion 20 of the shank 16 is, in this form of the invention, provided with an eye 21 to facilitate engagement of the formed button with adjacent material. The mid-portion of the shank 16 has a plurality of barbs 22 around them, preferably provided as substantially annular ridge members. However, it is to be appreciated that alternatively spaced and arranged barbs can be provided. The barbs are directed substantially inwardly of the recess 13 (that is, away from the end 20) and are located substantially inwardly of the recess 13 when the shank 16 is engaged with the outer body component 11.

Figure 2:
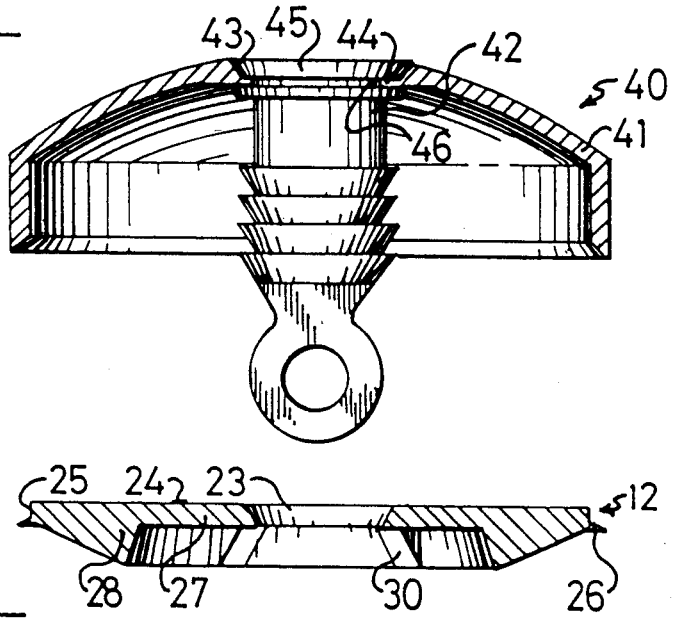
FIG. 2 is a cross-sectional view of a second button of the invention.
Figure 3:
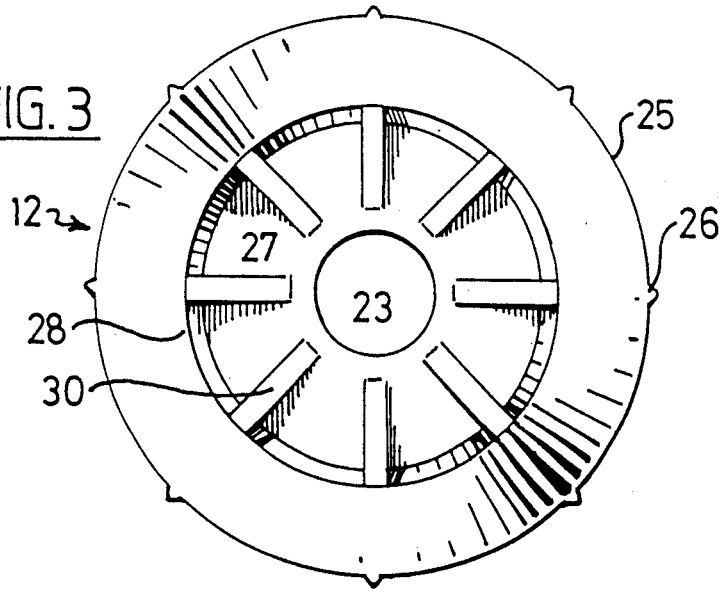
FIG. 3 is a plan view of an inner body component.

The inner body component 12 in this form of the invention is provided substantially as a washer member having a substantially medial aperture 23 (although the location depends on the shape and arrangement of the button and on the positioning of the shank 16). The aperture 23 is preferably provided so as to be outwardly tapered towards an inner face 24 of the inner body component 12. The periphery 25 of the inner body component 12 is arranged to be an interference fit with the inner periphery of the recess 13 of the outer body component 11. FIGS. 2 and 3 show the shape of the inner body component 12. It has a flat inner face 24 (facing towards the recess of the outer body component). The outer (or lower face) of the component 12 is contoured having an annulus 27 of reduced thickness surrounding the aperture 23. This thin annulus 27 terminates in a region 28 of maximum thickness which tapers towards the peripheral rim 25.

In this form of the present invention the peripheral edge 25 of the inner body component 12 is provided with teeth 26 (See FIG. 3), so that when the cover is engaged about it the teeth 26 engage the cover.

Preferably, the button assembly components are provided as a kitset and are assembled by the user. The assembly can be effected in a number of ways. For example, the user may place the outer body component into a recessed mould on top of a piece of cover material 29 cut to a predetermined size. (See also the description of the conventional two piece die set of FIG. 4 which is given below).

Figure 5:
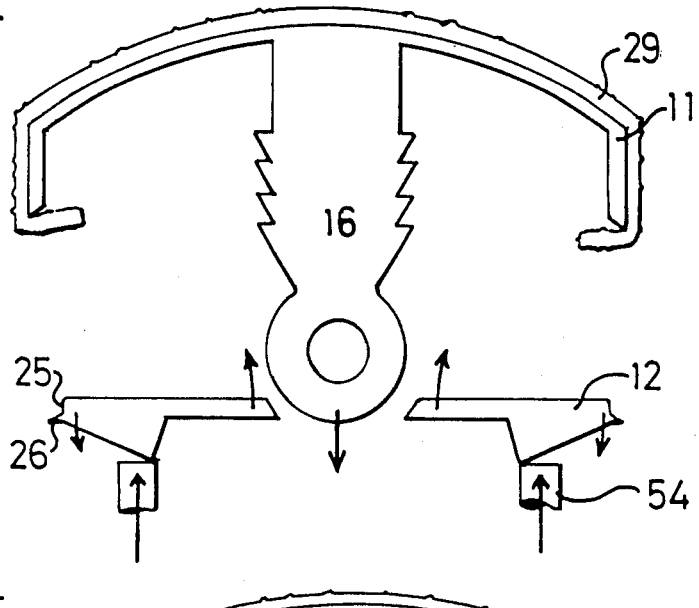
FIG. 5 is a cross-sectional view of a button of the invention, disassembled and in a first stage of assembly.

The mould forms the cover generally about the outer body component 11 and, then, the inner body component 12 is engaged over the shank 16 (see FIG. 5). The periphery 25 and teeth 26 engage adjacent portions of the cover, and subsequent pushing on the iner body component 12, such as by an apertured tool (providing room for the shank 16 to extend upwardly within it), forces the inner body component 12 over the barbs 22 and the periphery 25 of the inner body component 12 inwardly of the recess 13 to stretch the cover about the outer body component 11, the barbs 22 holding the assembly together.

The absence of teeth on the smooth inner face 24 or on the inside of the recess 13 allows the cloth covering to be easily positioned during assembly.

Figure 6:
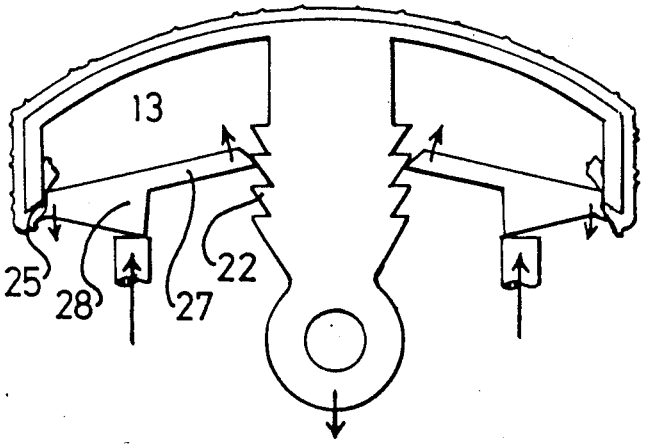
FIG. 6 is a cross-sectional view of a button as in FIG. 5, in a second stage of assembly, with arrows to show the various movements of parts.

By pushing an annular region 28 with a conventional die, the washer 12 is allowed to flex or "cup" slightly with annular region 28 acting as a fulcrum as shown in FIG. 6. In this way the central aperture expands slightly as it moves upwards whilst the peripheral rim 25 moves downwards thereby presenting a circle of lesser diameter than when in its resting state.

Figure 7:
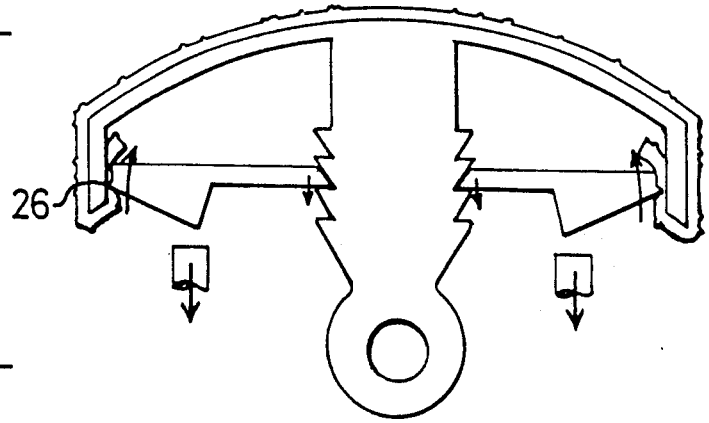
FIG. 7 is a cross-sectional view of a button as in FIG. 5, in a third stage of assembly, with arrows to show the various movements of parts.

The teeth 26 on the peripheral rim can thus engage the cloth covering, and when the pressure on the washer is relaxed it will snap back into its resting state as shown in FIG. 7, with the teeth 26 helping to pull the cloth covering taut as they move further into the recess.

In a further embodiment of the present invention the inner body component 12 is formed substantially as described above, but with additional reinforcing ribs 30. These ribs are arranged preferably radially spaced apart and taper toward its periphery 25. The exact configuration of the reinforcing ribs is relatively inessential, however, save that they should not be so formed as to cause an obstruction to forming of the button and/or its engagement with adjacent materials.

The reinforcing ribs, if provided, increase the strength of the inner body component 12 so that it may more readily resist stresses which might flex or distort the shape of the body component 12 and enable it to become dislodged from its engagement with remaining portions of the button.

FIG. 2 shows an alternative button 40 of the present invention, in which the outer body component 41 and shank 42 are formed as two separate pieces. Such a configuration may be simpler to manufacture, because of the difficulty in forming a mould to produce the shape of the component 11 described above. In the middle of the outer component 41 there is an aperture 43. Preferably, the aperture 43 is substantially tapered, reducing inwardly of the outer body component 41 and terminating in an engaging lip portion 44. The outer end of the shank 42 is provided with an enlarged head 45 which is outwardly tapered to co-operate with the inwardly tapered shape of the aperture 43.

Adjacent the head 45 there is provided a groove 46 within which the lip 44 engages (as shown in FIG. 2). Preferably, an adjacent rib 24 is provided beneath the groove 46 and the overall dimensions of the shank 42 including the groove 46 (excluding the head 45) are such that the shank 42 may be forced through the aperture 43, from the convex outer face side and that the lip portion 44 snaps into the reduced dimension portion to engage the shank 42. Preferably, the shank's engagement with the aperture is a rotating engagement with a certain amount of looseness. However, this is in no way essential, and it is envisaged that in alternative forms of the invention a tight or non-rotating engagement could be provided.

While the shank 42 is shown to be engaged in an aperture 43, it is envisaged that in alternative forms of the invention the shank 42 can be engaged in an alternative manner, such as by adhesives, radio frequency welding, pinslot engagement, bayonet coupling, and the like.

Figure 4:
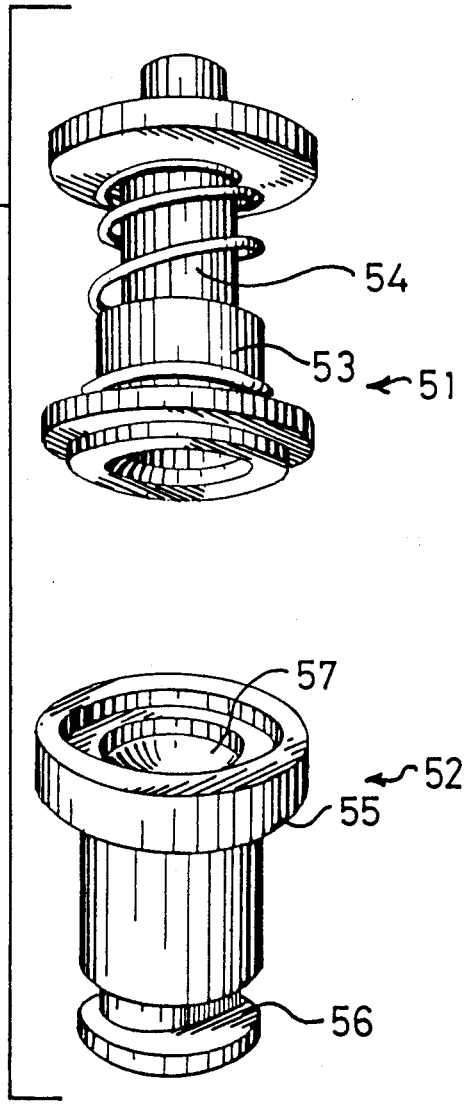
FIG. 4 is a perspective view of a die for forming a button of the present invention.

FIG. 4 illustrates a conventional two-piece die set for assembling metal shell buttons. It can be used to assemble the button of the invention without modification. It comprises two parts 51, 52, arranged to be aligned with each other. One part 51 comprises an outer piece 53 and an inner piece 54 arranged to be vertically movable within the outer piece. The other part comprises an outer piece 55 and an inner piece 56 arranged to be vertically movable within the outer piece 55. In use, the outer body component (with the shank assembled into it if necessary) is placed onto the shaped end face 57 of the inner piece 56 on top of a piece of cover material cut to a predetermined size. The mould forms the cover generally about the outer body component. The inner body component (12) is engaged over the shank and the two die parts 51, 52 are brought together. The relatively movable pieces 54, 56 are then pushed firmly and quickly together, and the button components are forced together, with the inner body component 12 undergoing flexion, as described above, thereby facilitating easier assembly without decreasing the degree of coherence between the component parts in the assembled state.

Various modifications to the above may be made without departing from the scope of the present invention as broadly defined or envisaged.

Other methods of assembling the buttons may be used. Different die mechanisms which would be suitable are already known, including some high-speed die machinery. Alternatively, the assembly could be effected manually. In some arrangements, the cap, or outer body component, with shank, is positioned face down in a die, and the piece of material is placed over it. The die then passes the cap and fabric assembly into a second, concave die. The washer, or inner body component, is placed within a third die, and the second and third dies are forced together, whereupon the washer is pushed into the cap, trapping the edges of the fabric.

Thus, by the present invention, there is provided a covered button in which the shank is supported from the shell, or outer body component, and an inner body component of plastics material, which traps the coverng material in place, is supported on the shank. Such a button can be covered using the conventional two piece die set without the need for special tooling. Thus the plastics button of this invention can be used in the same equipment as is used for assembly of metal shell buttons.

I claim:

1. A button assembly including an outer body component of plastics material, a recess in said outer body component, a shank of plastics material extending from within the recess of said outer body component and anchored thereto, and an inner body component of plastics material adapted to be substantially non-releasably snap-fitted into the recess of said outer body component about said shank; wherein the inner body component comprises an annular washer having a peripheral rim which is an interference fit in said recess of said outer body component, a substantially flat inner face which in use faces towards the recess of the outer body component, a contoured outer face, an aperture through said washer through which the shank projects, and an annulus of reduced thickness about said aperture terminating in a region of maximum thickness which tapers towards the peripheral rim of the washer to define the contoured outer face.

2. A button assembly as claimed in claim 1, wherein the shank and outer body component are separate pieces.

3. A button assembly as claimed in claim 1, wherein the inner body component includes protrusions about the peripheral rim.

4. A button assembly as claimed in claim 1, wherein radially disposed reinforcing ribs are provided on said contoured outer face of the annular washer extending across the annulus of reduced thickness to said region of maximum thickness.

5. A kitset for a button assembly including an outer body component forming at least part of the button periphery, a shank arranged to be anchored to and extend rearwardly of said outer body component and through a separate inner body component of plastics material, a recess provided in a rear face of said outer body component within which a periphery of said inner body component can engage and locate a covering engaged about at least a part of the outer body component and extending between the periphery of said inner body component and adjacent portions of said recess; wherein the inner body component comprises an annular washer having a peripheral rim which is an interference fit in said recess of said outer body component, a substantially flat inner face which in use faces towards the recess of the outer body component, a contoured outer face, an aperture through said washer through which the shank is adapted to project and on which said washer is adapted to be substantially non-releasably snap-fitted, an annulus of reduced thickness about said aperture terminating in a region of maximum thickness which tapers towards the peripheral rim of the washer to define the contoured outer face.

6. A kitset as claimed in claim 5, wherein the inner body component includes peripheral teeth.

7. A kitset as claimed in claim 5 wherein radially disposed reinforcing ribs are provided on said contoured outer face of the annular washer extending across the annulus of reduced thickness to said region of maximum thickness.

8. A button comprising an outer body component of plastics material and an inner body component of plastics material trapped substantially non-retrievably within a recess in the rear of the outer body component on a shank anchored on said outer body component and extending rearwardly thereof and through said inner body component, the edges of the inner body component being trapped securely between engaging surfaces of said outer and inner body components; wherein the inner body component comprises an annular washer having a peripheral rim which is an interference fit in said recess of said outer body component, a substantially flat inner face which in use faces towards the recess of the outer body component, a contoured outer face, an aperture through said washer through which the shank projects and on which said washer is substantially non-releasably snap-fitted, and an annulus of reduced thickness about said aperture terminating in a region of maximum thickness which tapers towards the peripheral rim of the washer to define the contoured outer face.

9. A button as claimed in claim 8, wherein radially disposed reinforcing ribs are provided on said contoured outer face of the annular washer extending across the annulus of reduced thickness to said region of maximum thickness.

* * * * *